US009510112B2

(12) United States Patent
Petersen et al.

(10) Patent No.: US 9,510,112 B2
(45) Date of Patent: Nov. 29, 2016

(54) EXTERNAL MICROPHONE ARRAY AND HEARING AID USING IT

(71) Applicant: Oticon A/S, Smørum (DK)

(72) Inventors: Svend Oscar Petersen, Smørum (DK); Mette Boel Pedersen, Smørum (DK); Gabriel Aldaz, Smørum (DK); Martin Bergmann, Smørum (DK); Regin Kopp Pedersen, Smørum (DK); Peter Sommer, Smørum (DK)

(73) Assignee: OTICON A/S, Smorum (DK)

( * ) Notice: Subject to any disclaimer, the term of this patent is extended or adjusted under 35 U.S.C. 154(b) by 314 days.

(21) Appl. No.: 14/099,242

(22) Filed: Dec. 6, 2013

(65) Prior Publication Data

US 2015/0049892 A1 Feb. 19, 2015

(30) Foreign Application Priority Data

Aug. 19, 2013 (EP) ..... 13180890

(51) Int. Cl.
*H04R 25/00* (2006.01)

(52) U.S. Cl.
CPC ..... *H04R 25/554* (2013.01); *H04R 25/407* (2013.01); *H04R 25/552* (2013.01); *H04R 25/558* (2013.01); *H04R 2201/401* (2013.01); *H04R 2225/43* (2013.01); *H04R 2430/23* (2013.01)

(58) Field of Classification Search
CPC combination set(s) only.
See application file for complete search history.

(56) References Cited

U.S. PATENT DOCUMENTS 5,793,875 A * 8/1998 Lehr ..... H04R 25/554 381/313
8,391,522 B2 * 3/2013 Biundo Lotito ..... 381/312

(Continued)

FOREIGN PATENT DOCUMENTS

EP 1 017 252 A2 7/2000
WO WO 2007/068243 A1 6/2007
WO WO 2007/137364 A1 12/2007

(Continued)

OTHER PUBLICATIONS

Zhiyun Ii and Ramani Duraiswami, Hemispherical Microphone arrays for sound capture and beamforming, Oct. 16-17, 2005, IEEE (2005), pp. 106-109.*

*Primary Examiner* — Duc Nguyen
*Assistant Examiner* — Assad Mohammed
(74) *Attorney, Agent, or Firm* — Birch, Stewart, Kolasch & Birck, LLP

(57) ABSTRACT

An external microphone array is configured to be used with a hearing aid and comprises a number of microphones configured to detect one or more sound signals from a sound source and means for wirelessly sending the detected sound signal to at least one hearing aid. The external microphone array comprises means for automatically determining the direction of the sound source either by: a) receiving a wireless signal transmitted from a remote control; b) by receiving acoustic signals picked up by the hearing aid(s) and by further comparing the signals with signals received by the external microphone array. The external microphone array may e.g. take the form of a sphere, a hemi-sphere or a neckband.

23 Claims, 7 Drawing Sheets

(56) References Cited

U.S. PATENT DOCUMENTS

2005/0117771 A1* 6/2005 Vosburgh ..... H04S 1/002 381/376
2006/0198530 A1* 9/2006 Fischer ..... H04R 25/70 381/60
2008/0240453 A1* 10/2008 Westergaard ..... H04R 25/70 381/60
2009/0172780 A1* 7/2009 Sukeda ..... H04N 7/17318 726/3
2010/0062713 A1* 3/2010 Blamey ..... H04M 9/082 455/41.3
2010/0316231 A1* 12/2010 Williams ..... H04R 3/005 381/92
2012/0020503 A1* 1/2012 Endo ..... G10L 21/0272 381/312
2013/0300648 A1* 11/2013 Kim ..... G06F 3/011 345/156

FOREIGN PATENT DOCUMENTS

WO WO 2008/098590 A1 8/2008
WO WO 2011/015675 A2 2/2011

* cited by examiner a)

b)

EXTERNAL MICROPHONE ARRAY AND HEARING AID USING IT

FIELD OF INVENTION

The present invention generally relates to an external microphone array and a hearing aid configured to be using it. The invention more particularly relates to an external microphone array that is provided with means for establishing the listening direction and to a hearing aid system comprising a hearing aid and an external microphone array.

PRIOR ART

It is well known that it is difficult for a hearing impaired person to hear speech in noisy environments and that the general way to improve the speech understanding is to improve the signal-to-noise ratio (SNR). A good way of improving the SNR is to use an external microphone that captures and transmits the desired speech signal to the hearing aids. Some of the advantages of an external microphone are that it can be placed close to the desired signal source, and that it is possible to achieve a high degree of spatial filtering of the noise and signal (higher than it is possible to achieve in the hearing aids).

In noisy environments moving the external microphone closer to the speaker is a proven way to improve speech understanding. The problem is that few people wants to draw attention to their hearing loss by placing an microphone on the table let alone mounting on the clothes of a speaker.

It is known to have an external microphone array that works together with a direction indicator providing a directionality that is being used to filter away noise from the desired signal, so that a better SNR can be achieved (better than with the hearing aids alone). Many of the prior art solutions are associated with problems, however.

The control of the external microphone array can be challenging and the user usually needs to point out the desired direction in which he wants to listen.

The audio signals from external microphone arrays are often transmitted and presented to the user in mono (same signal at each ear). This makes it difficult for the user to determine the direction of origin of the sound. Therefore, it can be very confusing for a hearing impaired person to participate in a discussion around a table if the hearing impaired person does not know who is talking.

Moreover, external accessories to hearing aids can easily be forgotten, especially if they are placed on a table, and if it is succeeded to make seamless interaction with them.

Another problem of the use of external microphones is that if the person wearing the microphone leaves the room to go to another room and forgets that he/she is wearing the microphone, then the hearing aid user could unintendedly still hear the other person without the other person knowing. Further, not only the other persons voice but also, snorting, coughing and other body sounds and fiddling and rattling with papers or bags are also (unnecessarily) transmitted from the microphone to the hearing aids on the hearing aid user.

Hearing solutions typically use directionality to enhance sound sources in the front of the hearing impaired person. A narrow focus directionality is beneficial in noisy environments but can cause issues as the directionality 'beam' moves with head movements/turns forcing the user to keep his/her head still in the speaker direction to avoid that the speaker comes out of the focus beam and becomes difficult to hear and follow.

It is thus in general difficult to control directionality of a hearing solution. Hearing instrument users in general wish to optimize the audio processing of their hearing instrument to best suit the current acoustic environment.

Present solutions to the problem include 1) discreet hearing aid programs that the user can change between, 2) automatic adjustment of setting in the HA based on analysis of the acoustic environment, 3) Remote control with display that allows user interaction, 4) the use of external microphones. Some of the current methods are rarely used by users because they are difficult to use, hard to remember or not sufficiently unobtrusive.

Hearings aids are in general very limited in computing power due to their extremely small size battery capacity (the housing containing such power supply being e.g. of the order of centimeters). This limits the degree of sophistication of the audio processing that is possible. While the use of directionality has improved noise reduction in a typical hearing aid comprising two microphones located relatively close together in the housing of the hearing aid, it is limited what can be done with these microphones compared with a multi-array of microphones. Because of the typical microphone placement (in or at the ears of a user), hearing aids are ill suited for wireless headset use (to pick up the user's voice). The microphones are too far from the user's mouth to give adequate sound in noisy environments. Extremely small hearing aids (and legacy hearing aids) does not have the necessary wireless functionality for direct SmartPhone connectivity, which make an intermediary device necessary. Current 'intermediary' devices (e.g. so-called audio gateways, cf. e.g. EP 1 460 769 A1, or EP 1 981 253 A1) are not rated as attractive by end-users and may draw unwanted and unnecessary attention to the user's hearing impairment.

SUMMARY OF THE INVENTION

Thus, there is need for an external microphone or microphone array that reduces or even eliminates these drawbacks of the prior art.

It is an object of the present invention to provide an improved external microphone array that provides an improved hearing experience for a user of a hearing aid using the external microphone array.

It is also an object of the present invention to provide an external microphone array that automatically detects the listening direction.

Besides, it is an object of the present invention to provide an external microphone array that is easy to remember for the user of the hearing aid, when the user is no longer in the same room as the external microphone array.

An External Microphone Array:

Objects of the present invention can be achieved by an external microphone array, a hearing aid system and by a method as defined in the respective claims. Preferred embodiments are defined in the dependent sub claims and explained in the following description and illustrated in the accompanying drawings.

The external microphone array is an external microphone array configured to be used with a hearing aid, which microphone array comprises a number of microphones configured to detect one or more sound signals from a sound source and transmitter circuitry for wirelessly transmitting the detected sound signals to at least one hearing aid. The external microphone array comprises processing unit for automatically determining the direction of the sound source either by:

a) receiving a wireless signal transmitted from a remote control or; or
b) receiving wireless signals representing acoustic signals picked up by the hearing aid(s) (e.g. by a binaural fitting) and by further comparing the signals with corresponding signals received by the external microphone array.

Hereby it is possible to provide an improved external microphone array that facilitates an enhanced hearing experience for the user of the hearing aid using the external microphone array. It is a major advantage for the user that the external microphone array automatically detects the listening direction.

In the present context, 'the direction of the sound source' (when nothing else is specified or implied) is taken to mean the direction of the sound source as measured or seen from the user of the hearing aid.

The term 'external microphone array' is in the present context taken to mean 'external relative to the hearing aid' in the sense that the external microphone array comprises a separate housing that is not integrated with a hearing aid housing. In practice, the external microphone array is a separate device that is spatially separated from the hearing aid, e.g. located a certain distance (e.g. ≥0.1 m, such as more than 0.5 m from the hearing aid).

The external microphone array may comprise any type of external microphone array configured to be used with any suitable type of hearing aid.

The external microphone array may comprise any suitable number of microphones (at least one, but preferably two or more, such as three or more, such as four or more). The microphones may be of any suitable type and be configured in any suitable manner. The microphones of the external microphone array are preferably arranged in a predefined geometrical pattern (where the mutual relative location of the microphones is known; the pattern being periodic or non-periodic). In an embodiment, the microphones are located in a regular, periodic array on a geometrical surface (e.g. in a plane or on one or more surfaces (e.g. all) of a three dimensional polyhedral or non-polyhedral (e.g. spherical) body).

The external microphone array comprises transmitter circuitry (e.g. an antenna and transmitter unit) for wirelessly sending (transmitting) detected sound signals to at least one hearing aid. The transmitter circuitry may be of any suitable type and structure, e.g. based on near-field (e.g. based on inductive coupling) communication or far-field communication (e.g. based on radiated fields).

The external microphone array comprises a processing unit for automatically determining the direction of the sound source so that information about the direction of the sound source can be used to provide an enhanced sound experience by the user of the hearing aid(s).

Preferably, the external microphone array is configured to receive a signal from a portable device, e.g. a remote control device or a communication device, e.g. a SmartPhone, the SmartPhone possibly running an APP allowing a particular signal to be transmitted). Preferably, the portable device (e.g. a remote control or a SmartPhone having the function of a remote control) is located at or near the user. It is possible for the processing unit of the external microphone array to automatically determine the direction of the sound source (relative to the hearing aid/user) by receiving a wireless signal transmitted from a remote control. Preferably, the external microphone array is located farther away from the user wearing the hearing aid than the remote control. In an embodiment, the remote control is configured to, either automatically or manually initiated, transmit a signal, e.g. an ultrasonic signal, to the external microphone array. Thereby, a direction from the external microphone array to the remote control (user/hearing aid) can be determined by the processing unit of the external microphone array. The direction of the sound source relative to the external microphone array may be detected by the external microphone array (e.g. by a directional algorithm). By using the information about the direction of the sound source relative to the external microphone array and the wireless signal transmitted from the remote control to the external microphone array it is possible to establish the direction of the sound source (relative to the hearing aid/user).

It is preferred that the portable device (here termed remote control) is arranged between the user of the hearing aid and the external microphone array. It may be an advantage that the remote control is arranged between the user of the hearing aid and the external microphone array in such a way that the direction of the remote control (to the external microphone array) and the direction of the user (to the external microphone array) are basically equal. In practise, it may be achieved by placing the user of the hearing aid, the remote control and the external microphone array on straight line.

It is possible to automatically determine the direction of the sound source that a user wants to listen to (assuming e.g. that the user looks in a direction of the sound source, e.g. a talker) by receiving acoustic signals picked up by the hearing aid(s) (e.g. by a binaural fitting) and by further comparing the signals with signals received by the external microphone array. Preferably, the processing unit of the external microphone array is configured to perform the comparison. This requires that the currently received signal (or a part thereof)—in a specific sound source search mode—is transmitted from the hearing aid(s) to the external microphone array, and that the external microphone array comprises appropriate receiver circuitry for this purpose). Preferably, the external microphone array is configured to enter a specific sound source search mode, wherein the external microphone array is adapted to have a predefined directional characteristic (e.g. covering a predefined angle of space) is shifted in a number of steps (e.g. more than 2, such as more than 4) through a certain (e.g. predefined, relevant) angle of space, e.g. 360° or less, such as 180° or less. In each step, the processing unit is configured to compare the signal received by the external microphone array with the signal received by the hearing aid(s). By comparing the acoustic signals picked up by the hearing aid(s) with the signals received from the external microphone array it is possible to determine those signals received by the external microphone array that, to the highest degree, correspond to the signals received from the external microphone array. Thereby the direction corresponding to the directional characteristic of the microphone array for which the best correlation is achieved can be chosen as the (presently) relevant direction. The best correlation can e.g. be determined by a (preferably simplified) cross-correlation measure, e.g. a based on envelopes of the respective audio signals. Preferably, the external microphone array is configured to terminate the sound search mode and adapt its directional characteristic to cover the identified direction from the array to the sound source and to transmit the resulting sound signal picked up by the array to the hearing aid(s) as the presently relevant signal. In an embodiment, the external microphone array (e.g. the processing unit) is configured to enter (or leave) the sound source search mode dependent on a mode control input signal. In an embodiment, the remote control and/or the hearing aid(s) and/or the external microphone array itself comprises a user interface enabling initiation of the generation of said mode control input signal. In an embodiment, the mode control input signal is automatically generated, e.g. according to a user's head movement (as e.g. determined by a directional algorithm of the hearing aid(s) and or a movement sensor located in the hearing aid(s)).

In an embodiment, the external microphone array (e.g. the processing unit) is configured to—after automatically determining the direction of the sound source—apply a head related transfer function (HRTF) to the signals received by the microphone array and providing signals to the hearing aid(s) in such a way that the processed signals basically appears as if they originated from the (direction of the) sound source. Thus, the user of the hearing aid experiences the sound as if originating from the sound source and therefore, the user can change the orientation of his head towards the sound source in order to achieve optimum hearing conditions e.g. during a meeting or a conversation. Alternatively, the application of the head related transfer function to the signals received by the microphone array can be performed in another device, e.g. an appropriately configured processing unit of the hearing aid(s) or a remote control (e.g. a SmartPhone).

In an embodiment, the external microphone array is implemented in a SmartPhone. In an embodiment, the SmartPhone comprises an APP as part of the solution. In an embodiment, a display of the SmartPhone and the APP provides a user interface for the external microphone array. In an embodiment, the SmartPhone is configured to transmit the audio signal picked up by its microphone array wirelessly a) to an intermediate device (e.g. an audio gateway), which relays it to the hearing aid(s) and/or b) directly to the hearing aid(s). In an embodiment, a signal processing unit of the SmartPhone is configured to process the signal picked up by the external microphone array, e.g. to reduce background noise, to apply HRTFs, to provide clues about the acoustical environment to the hearing aids for optimizing program settings, etc. Preferably, relatively demanding processing tasks can be performed by the SmartPhone.

In an embodiment, the external microphone array (e.g. a SmartPhone) is adapted to establish a wireless link according to a specific communication standard, e.g. Bluetooth (such as Bluetooth Low Energy).

Advantages of implementing the external microphone array in a SmartPhone are e.g. that a) no (extra) separate device is needed (the SmartPhone is generally always around), b) processing power is available for better sound quality and noise reduction, c) a multitude of sensors and APPs are readily available for combination with the external microphone array, e.g. an orientation or movement sensor for assisting in determining the direction of the sound source (e.g. an accelerometer and/or a gyroscope).

In an embodiment, such movement sensor of the SmartPhone is used to mute or activate the external microphone array by simply turning the SmartPhone, e.g. so that the backside or display-side is up when the external microphone array is intended to be muted or activated, respectively. Thereby the need to interacting with the display for these purposes is eliminated.

It may be beneficial that the external microphone array has a spherical geometry.

The spherically shaped microphone array makes it possible to decompose the sound field into spherical harmonics eigenfunctions and hereby achieve a high spatial resolution of the beamforming.

As the spatial resolution of the beamforming depends on the degree of spherical harmonics used (which is determined by the number of microphones on the sphere), a higher spatial resolution improves the signal-to-noise ratio and thus the hearing experience of the user of the hearing aid.

Accordingly, the microphone array is suitable for facilitating hearing of speech in noisy environments by improving the signal-to-noise ratio.

By decomposing the sampled sound field into spherical harmonics eigenfunctions a high directional beamforming response can be achieved. It is possible to achieve a higher directionality than by using traditional beamforming algorithms such as "delay and sum" beamforming.

It may be an advantage that the external microphone array has a hemi-spherical geometry (half of a sphere). It may be preferred that the external microphone array has a hemi-spherical geometry and is configured to be arranged on a table. Preferably the microphone array is a hemi-spherical microphone array and comprises a plurality of microphones attached to a hard acoustically reflecting hemi-sphere.

By applying a hemi-spherical microphone array that is arranged on a hard (acoustically) reflecting surface, such as a table, the reflecting surface will reflect the sound field like a mirror. Accordingly, the measured sound can be used to predict the sound field on a complete sphere. Hereafter the sound field can be decomposed into spherical harmonics eigenfunctions and thus a high directional beamforming response can be achieved.

When used within a hearing aid system it is possible to steer the array in order to "focus" or "listen" in a desired direction. Hereby, it is possible to apply the microphone array to improve hearing of speech in noisy environments by improving the signal-to-noise ratio.

It may be beneficial that a plurality of microphones is provided at the surface (e.g. periphery) of the spherical or hemi-spherical geometry of the external microphone array. In an embodiment, the plurality of microphones are distributed over the surface in a predefined pattern. In an embodiment, the plurality of microphones are evenly distributed over the surface.

Hereby an optimum configuration of the plurality of microphones can be provided. The number of microphones may by way of example be 4, 8, 16, 32 or 64.

A Hearing Aid System:

In an aspect, a hearing aid system comprising at least one hearing aid and an external microphone or an external microphone array, e.g. an external microphone array as described above, in the detailed description of the invention and in the claims is provided. Embodiments of such hearing aid system may provide a high SNR in noisy environments and thus such hearing aid system is highly suited to be used to perceive speech in noisy environments.

It may an advantage that the hearing aid system comprises a remote control configured to provide a highly visual acoustical control, where the remote control is a SmartPhone or a tablet. Hereby the SmartPhone or a tablet may instantly response to the user both visually and acoustically.

The remote control provides a visual and discreet way of optimising audio processing of a hearing aid. As most people already have a SmartPhone the user of the hearing aid does not need to carry a separate remote control.

It may be beneficial that the hearing aid(s) comprise means for analysing acoustic signals picked up by the hearing aids and hereby automatically determining the direction of the sound source.

Hereby the direction of the sound source can be established in an easy and simple way. The determination of the direction of the sound source may be provided by analysing the acoustic signals picked up by the hearing aids on the ears of the user, e.g. by a binaural fitting, and by further comparing the signals with signals from the external microphone array it is possible to establish the direction of the signal that correlates most with the signal from the hearing aids. This signal can be transmitted from the external microphone array to the hearing aids once it has been selected.

It may be an advantage that the hearing aid system comprises a control device provided with classification means for classification of signals detected from a sound source (e.g. if a signal is of interest or not) and means for analysing the classified signals. The classification and analysis means may be embodied in the external microphone array, e.g. forming part of a remote control (of the hearing aid(s)), e.g. in the form of a SmartPhone.

Hereby it is possible to apply the classification in order to automatically process the sound signals according to their relevance to the user in order to attenuate noise and amplify sound sources in accordance with the classification. Accordingly, the user of the hearing aid system will hear the relevant sounds more clearly while unwanted sounds are attenuated. The classification may, for instance, be established by use of push buttons or activation areas of a touch sensitive display.

It may be beneficial that the hearing aid system comprises means for tagging classified signals and their associated sound sources, where the hearing aid system further comprises means for using this information to steer the prioritisation and attenuation of sound sources. Once the classified signals and their associated sound sources have been tagged it is possible to process the sounds according to a set of user specific criteria. Thus, the user of the hearing aid will be able to hear speech in a noisy environment regardless of the direction of the users head and head rotations. By using such procedure it is possible to indicate if the sound source is of interest or if it should be attenuated.

It may be advantageous that the hearing aid system comprises an external microphone or external microphone array (e.g. embodied in a SmartPhone) configured to be worn by a person (other than the hearing aid user), which external microphone or external microphone array is provided with a voice detection system configured to detect if the person wearing the external microphone or external microphone array is speaking, where the hearing aid system (in particular the external microphone or external microphone array) is configured to transmit signals to the hearing aid(s) when the (other) person is speaking, where the hearing aid system is configured not to transmit signals to the hearing aid(s) when the (other) person is not speaking.

Hereby it is possible to reduce transmission of noisy signals such as rustle or rattling to the user of the hearing aid while sound signals representing speech is still transmitted to the user of the hearing aid.

It may be beneficial that the hearing aid system comprises a body vibration voice detector configured to detect vibrations on the body of the person wearing the external microphone or external microphone array. Hereby the hearing aid system is configured to determine when the external microphone receives signals from the persons own voice, and only transmit the microphone signal when present.

The body vibration voice detector may be integrated into the external microphone array.

It may be an advantage that the hearing aid system comprises an external microphone or external microphone array and means for alerting the user of the hearing aid(s) by providing a signal, preferably an audio signal such as a beep in the hearing aid(s) when the wireless connection to the external microphone or the external microphone array is lost.

Hereby it is possible to remind the user that the external microphone array is forgotten or that the connection is lost.

A Method of Operating an External Microphone Array:

The method according to the invention is method of operating an external microphone array configured to be used with a hearing aid, which microphone array comprises a number of microphones configured to detect a sound signal from a sound source and means for wirelessly transmitting the detected sound signal to at least one hearing aid. The method automatically determines the direction of the sound source either by:

a) receiving a wireless signal transmitted from a remote control; or
b) receiving wireless signals representing the acoustic signal(s) picked up by the hearing aid(s) (e.g. by a binaural fitting) and by further comparing the signal(s) with corresponding signals received by the external microphone array.

The method makes it possible to facilitate an improved hearing experience for a user of a hearing aid using the external microphone array.

It is intended that some or all of the structural features of the external microphone array or the hearing aid system described above, in the 'detailed description of embodiments' or in the claims can be combined with embodiments of the method, when appropriately substituted by a corresponding process and vice versa. Embodiments of the method have the same advantages as the corresponding devices.

It may be an advantage that the method comprises the step of applying an external microphone array having a spherical or hemi-spherical geometry. Hereby it is possible to decompose the sound field into spherical harmonics eigenfunctions and hereby achieve a high spatial resolution of the beamforming so that an improved SNR and thus a better hearing experience can be achieved. Accordingly, the method is suitable for being applied to facilitate hearing of speech in noisy environments by improving the SNR.

It may be an advantage that the method comprises the step of receiving one or more signals from a remote control or a control device. Hereby it is possible to improve the method by adding useful information e.g. information about the desired listening direction or information about the direction of the remote control/control device.

In an embodiment, the method comprises applying a head related transfer function (HRTF) to the signal(s) received by the microphone array and providing signals to the hearing aid(s) in such a way that the processed signals basically appears as if they come from the direction of the sound source.

DEFINITIONS

In the present context, a "hearing aid" refers to a device, such as e.g. a hearing device, a listening device or an active ear-protection device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A "hearing aid" further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve and/or to the auditory cortex of the user.

A hearing aid may be configured to be worn in any known way, e.g. as a unit arranged behind the ear with a tube leading air-borne acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. A hearing aid may comprise a single unit or several units communicating electronically with each other.

More generally, a hearing aid comprises an input transducer for receiving an acoustic signal from a user's surroundings and providing a corresponding input audio signal and/or a receiver for electronically receiving an input audio signal, a signal processing circuit for processing the input audio signal and an output means for providing an audible signal to the user in dependence on the processed audio signal. Some hearing aids may comprise multiple input transducers, e.g. for providing direction-dependent audio signal processing. In some hearing devices, the receiver may be a wireless receiver. In some hearing devices, the receiver may be e.g. an input amplifier for receiving a wired signal. In some hearing devices, an amplifier may constitute the signal processing circuit. In some hearing aids, the output means may comprise an output transducer, such as e.g. a loudspeaker for providing an air-borne acoustic signal or a vibrator for providing a structure-borne or liquid-borne acoustic signal. In some hearing aids, the output means may comprise one or more output electrodes for providing electric signals.

In some hearing aids, the vibrator may be adapted to provide a structure-borne acoustic signal transcutaneously or percutaneously to the skull bone. In some hearing aids, the vibrator may be implanted in the middle ear and/or in the inner ear. In some hearing aids, the vibrator may be adapted to provide a structure-borne acoustic signal to a middle-ear bone and/or to the cochlea. In some hearing aids, the vibrator may be adapted to provide a liquid-borne acoustic signal in the cochlear liquid, e.g. through the oval window. In some hearing aids, the output electrodes may be implanted in the cochlea or on the inside of the skull bone and may be adapted to provide the electric signals to the hair cells of the cochlea, to one or more hearing nerves and/or to the auditory cortex.

A hearing aid may e.g. be configured in one or more of the following ways:

In an embodiment, the hearing aid device is adapted to provide a frequency dependent gain to compensate for a hearing loss of a user. In an embodiment, the hearing aid comprises a signal processing unit for enhancing the input signals and providing a processed output signal.

The hearing aid comprises an output transducer for converting an electric signal to a stimulus perceived by the user as an acoustic signal. In an embodiment, the output transducer comprises a vibrator of a bone conducting hearing device. In an embodiment, the output transducer comprises a receiver (speaker) for providing the stimulus as an acoustic signal to the user.

The hearing aid comprises an input transducer for converting an input sound to an electric input signal. In an embodiment, the hearing aid comprises a directional microphone system adapted to enhance a target acoustic source among a multitude of acoustic sources in the local environment of the user wearing the hearing aid. In an embodiment, the directional system is adapted to detect (such as adaptively detect) from which direction a particular part of the microphone signal originates. This can be achieved in various different ways as e.g. described in the prior art.

In an embodiment, the hearing aid comprises an antenna and transceiver circuitry for wirelessly receiving a direct electric input signal from another device, e.g. a communication device or another hearing aid. In an embodiment, the direct electric input signal represents or comprises an audio signal and/or a control signal and/or an information signal.

In an embodiment, the hearing aid is a portable device, e.g. a device comprising a local energy source, e.g. a battery, e.g. a rechargeable battery. In an embodiment, the hearing aid is a low power device. The term 'low power device' is in the present context taken to mean a device whose energy budget is restricted, e.g. because it is a portable device, e.g. comprising an energy source of limited size, e.g. a battery such as a rechargeable battery.

In an embodiment, the hearing aids comprise an analogue-to-digital (AD) converter to digitize an analogue input with a predefined sampling rate, e.g. 20 kHz. In an embodiment, the audio processing devices comprise a digital-to-analogue (DA) converter to convert a digital signal to an analogue output signal, e.g. for being presented to a user via an output transducer.

In an embodiment, the audio processing device (and or the external microphone array), e.g. the input transducer (e.g. a microphone unit and/or a transceiver unit) comprise(s) a TF-conversion unit for providing a time-frequency representation of an input signal.

The hearing aid comprises a forward or signal path between the input transducer (e.g. a microphone system and/or direct electric input (e.g. a wireless receiver)) and the output transducer. In an embodiment, the signal processing unit is located in the forward path. In an embodiment, the signal processing unit is adapted to provide a frequency dependent gain according to a user's particular needs. In an embodiment, the hearing aid comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing aid comprises a level detector (LD) for determining the level of an input signal (e.g. on a band level and/or of the full (wide band) signal). In a particular embodiment, the hearing aid comprises a voice detector (VD) for determining whether or not an input signal comprises a voice signal (at a given point in time). In an embodiment, the hearing aid comprises an own voice detector for detecting whether a given input sound (e.g. a voice) originates from the voice of the user of the system. In an embodiment, the hearing aid comprises a noise detector. In an embodiment, the hearing aid comprises a signal to noise ratio detector (estimator). Noise level estimation and/or SNR estimation may e.g. be performed in combination with a voice activity detector (VAD), as indicated above.

In an embodiment, the hearing aid comprises an acoustic (and/or mechanical) feedback suppression system.

In an embodiment, the hearing aid further comprises other relevant functionality for the application in question, e.g. compression, noise reduction, etc.

In an embodiment, the hearing aid comprises a hearing assistance device, e.g. a listening device, e.g. a hearing instrument (e.g. a hearing instrument adapted for being located at the ear or fully or partially in the ear canal of a user), a headset, an earphone, an ear protection device or a combination thereof.

A "hearing aid system" refers to a system comprising one or two hearing aids such as a "binaural hearing aid system" that refers to a system comprising one or two hearing aids and being adapted to cooperatively provide audible signals to both of the user's ears. Hearing systems or binaural hearing systems may further comprise "auxiliary devices", which communicate with the hearing aids and affect and/or benefit from the function of the hearing aids. Auxiliary devices may be e.g. remote controls, remote microphones, audio gateway devices, mobile phones, public-address systems, car audio systems or music players. Hearing aids, hearing aids systems or binaural hearing aid systems may e.g. be used for compensating for a hearing-impaired person's loss of hearing capability, augmenting or protecting a normal-hearing person's hearing capability and/or conveying electronic audio signals to a person.

DESCRIPTION OF THE DRAWINGS

The invention will become more fully understood from the detailed description given herein below. The accompanying drawings are given by way of illustration only, and thus, they are not limitative of the present invention. In the accompanying drawings:

FIG. 2 *b*) shows a top view of a hearing aid system and an external microphone array according to the invention;

FIG. 3 *b*) shows a view of a control device of a hearing aid device according to the invention;

DETAILED DESCRIPTION OF THE INVENTION

Figure 1:
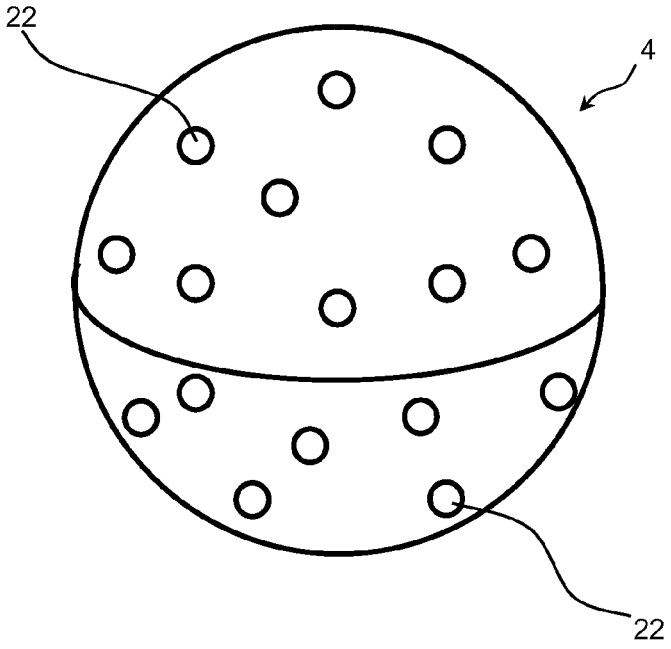
FIG. 1 shows perspective views of two different microphone arrays according to the invention, FIG. 1 *a*) in a spherical and FIG. 1*b*) a half-spherical configuration.
Figure 1:
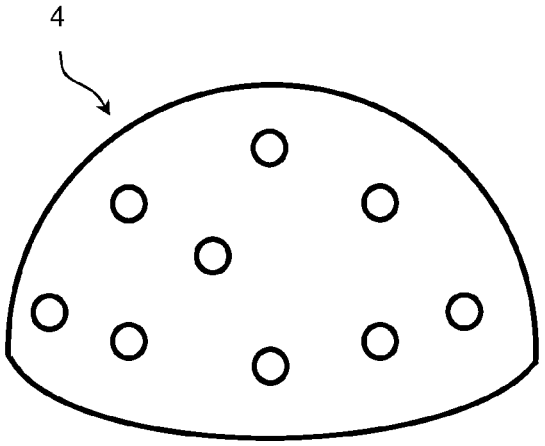

Referring now in detail to the drawings for the purpose of illustrating preferred embodiments of the present invention, perspective views of two microphone arrays according to the invention are illustrated in FIG. 1.

FIG. 1 *a*) illustrates a perspective view of a microphone array 4 having a spherical geometry. The spherical microphone array 4 comprises a plurality of microphones 22 attached to a hard acoustically reflecting sphere, where the equator is indicated.

The microphone array 4 is intended to facilitate hearing of speech in noisy environments by improving the signal to noise ratio SNR, e.g. by spatial filtering (directionality/beamforming).

The microphone array 4 is configured to wirelessly send measured sound signals to a hearing aid device (not shown) capable of decomposing the sampled sound field.

By decomposing the sampled sound field into spherical harmonics eigenfunctions a high directional beamforming response can be achieved. It is possible to achieve a higher directionality than by using traditional beamforming algorithms such as "delay and sum" beamforming (cf. e.g. EP 1 579 728 B1).

The spherical shaped microphone array 4 makes it possible to decompose the sound field into spherical harmonics eigenfunctions and hereby achieve a high spatial resolution of the beamforming.

Moreover, it is important to bear in mind that the spatial resolution of the beamforming depends on the degree of spherical harmonics used, which is determined by the number of microphones 22 on the sphere. A higher spatial resolution improves the SNR and thus the experience of the user of the hearing aid.

The directional characteristics of a sound source are changed substantially by the reflecting surfaces around it. The directivity index (DI) is an expression in decibels of the directionality of the sound source. The directivity index is the difference between sound pressure level in any given direction in the acoustic far field and the average sound.

While the directivity index of "delay and sum" beamforming is frequency dependant (where low directionality index is achieved at low frequencies), the directionality index for spherical harmonics beamforming is not frequency dependant. The low frequency limit is determined by the matching of the microphones 22. Accordingly, it is an advantage to apply a microphone array 4 having a spherical geometry (preferably using matched microphones).

FIG. 1*b*) illustrates a perspective view of a microphone array 4 having a hemi-spherical geometry. The hemi-spherical microphone array 4 comprises a plurality of microphones 22 attached to a hard acoustically reflecting hemisphere.

When the hemi-spherical microphone array 4 is arranged on a hard reflecting surface, such as a table, the reflecting surface will reflect the sound field like a mirror. Accordingly, the measured sound can be used to predict the sound field on a complete sphere. Hereafter the sound field can be decomposed into spherical harmonics eigenfunctions and thus a high directional beamforming response can be achieved.

When used within a hearing aid system it is possible to steer the array in order to "focus" or "listen" in a desired direction. Hereby, it is possible to apply the microphone array 4 to make it easier to hear speech in noisy environments by improving the SNR.

In various embodiments, the microphones are located on the spherical or half-spherical surface in a predefined, preferably symmetric pattern (where the symmetry is e.g. a rotational symmetry around an axis of the sphere (or half-sphere) through its centre, and where the symmetry is 2-fold or more).

Figure 2:
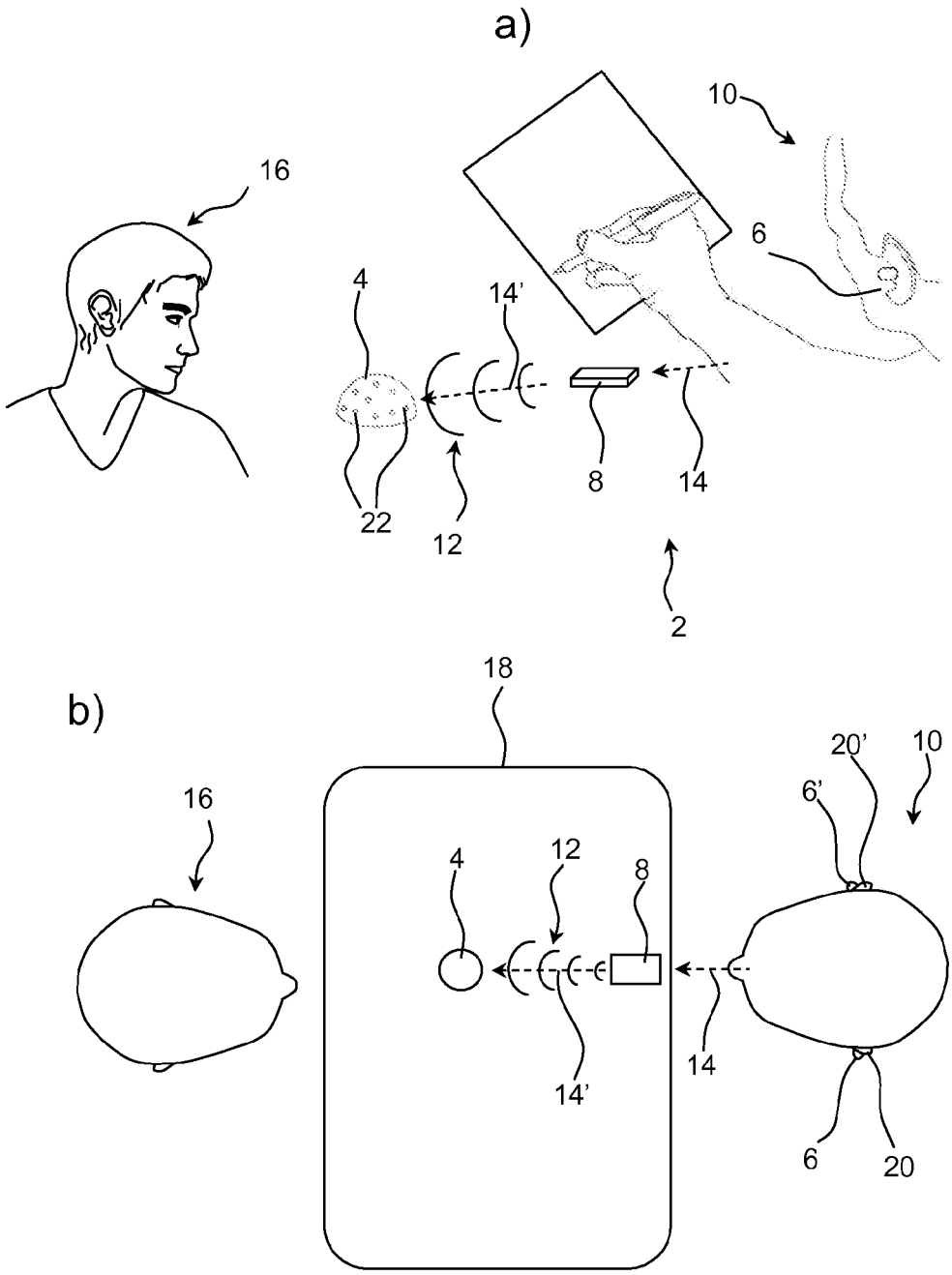
FIG. 2 *a*) shows a perspective view of a hearing aid system applying an external microphone array according to the invention.

FIG. 2 illustrates schematically views of a hearing aid system 2 according to the invention. FIG. 2 *a*) illustrates a perspective view of the hearing aid system while FIG. 2 *b*) illustrates a top view of the hearing aid system 2.

The hearing aid system 2 comprises hearing aids 6, 6' arranged on or at the ears 20, 20' of the user 10 of the hearing aid 6. The user 10 is in a meeting with another participant 16 (representing a sound source) sitting in front of the user 10.

The hearing aid system 2 comprises an external microphone array 4 arranged on a table (not shown) between the user 10 and the other meeting participant 16. The external microphone array 4 comprises a plurality of microphones 22 and has a hemi-spherical geometry and corresponds to the one shown in FIG. 1 *b*).

The hearing aid system 2 comprises a wireless remote control 8 that is arranged on the table (not shown) in front of the user 10 between the microphone array 4 and the user 10.

Although not shown, there may be several sound sources (e.g. other participants). The main challenge in such situations is to apply a characteristic to the external array 4 to pick up the sound close to the sound source (the other meeting participant 16 that is talking) and filter away undesired noise. This may be done by using a hearing aid system 2 according to the one illustrated in FIG. 2 *a*); however, it is required to determine the desired direction in which the microphone array 4 is intended to focus. This may be done by using the wireless remote control 8 that may be similar to the control device 24 shown in FIG. 3 *b*).

The present invention makes it possible to control the listening direction of the microphone array 4 automatically. If the user 10 wants the external microphone array 4 to listen to the other participants 16 the microphone array 4 needs to know the direction 14 of the user 10.

The direction 14 of the user 10 is detected by the microphone array 4 by transmitting an ultrasonic signal 12 from the remote control 8 to the external microphone array 4. The microphone array 4 detects the ultrasonic signal 12 by the microphones 22, and thus the direction 14' of the remote control 8 (and hereby the direction 14 of the user 10) can be established. It is simply assumed that the direction 14' of the remote control 8 and the direction 14 of the user 10 are equivalent.

It is possible to provide the hearing aids 6, 6' on the ears 20, 20' with means for analysing the acoustic signals picked up by the hearing aids 6, 6' on the ears 20, 20' in order to automatically determine the direction of the sound source (the other participant 16 in this case). Under optimum conditions the direction of the sound source equals the direction in which the user 10 is looking.

By analysing the acoustic signals captured by the hearing aids 6, 6' on the ears 20, 20' of the user 10, e.g. by binaural a fitting (comprising first and second hearing aids 6, 6' furnished with transceiver circuitry allowing an exchange of information and/or audio signals between the two hearing aids), and by further comparing the signals with signals from the external microphone array 4, it is possible to establish the direction of the signal that correlates most with the signal from the hearing aids 6, 6'. This signal can be selected and be transmitted from the external microphone array 4 to the hearing aids 6, 6'.

The hearing aid system 2 may be configured to improve the spatial sound interpretation and to work with an external microphone array 4 that automatically controls the listening direction.

When the hearing aid system 2 has detected the preferred listening direction of the user 10, the information of the direction can be used to reproduce the transmitted mono audio signal as if it came from a particular direction in space, by applying a HRTF to the signal. It may be an advantage that the external microphone array 4, the hearing aids 6, 6' or another device (e.g. an audio gateway, a SmartPhone or remote control 8) comprises means for applying the HRTF to the signal.

If the direction of the head of the user 10 is known and the position of the external microphone array 4 relative to the head of the user 10 is known, it is possible to reproduce the sound as if it came from the actual direction. There may, however, be errors in case the sound source is not in the far field.

Figure 3:
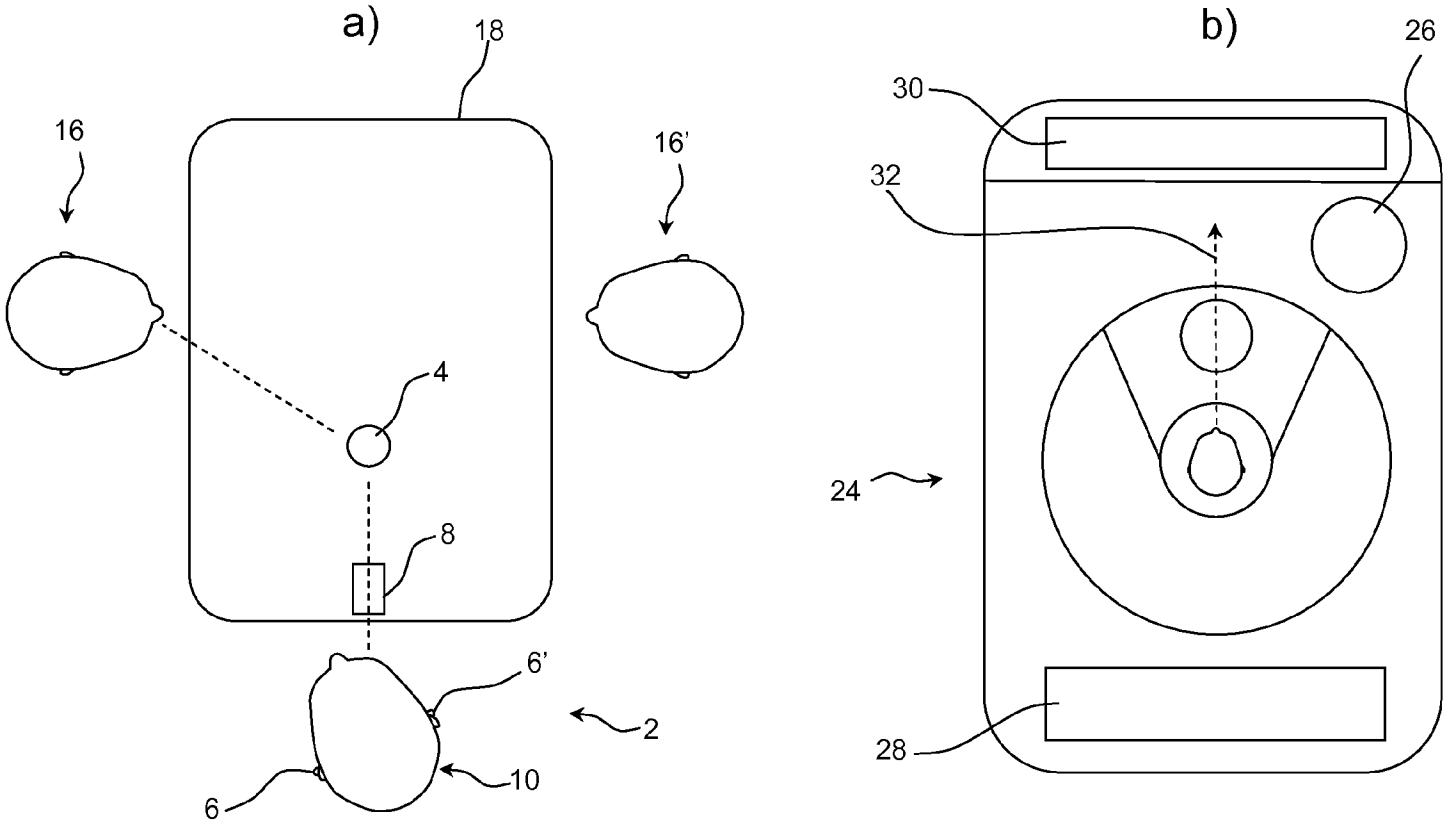
FIG. 3 *a*) shows a top view of a hearing aid system according to the invention.

FIG. 3 *a*) schematically illustrates a top view of a hearing aid system 2 according to the invention. The hearing aid system 2 comprises a set of hearing aids 6, 6' arranged at or in the ears of the user 10 of the hearing aid system 2. The hearing aid system 2 also comprises an external microphone array 4 arranged on the table 18 and a remote control 8 arranged on the table 18 between the external microphone array 4 and the user 10 of the hearing aid system 2. The remote control 8 may alternatively be held by or be attached to the user 10 of the hearing aid system 2.

The user 10 of the hearing aid system 2 is sitting at the head of a table 18 while a first person 16 is sitting at the left side of the table 18 and a second person 16' is sitting at the right side of the table 18.

FIG. 3 *b*) illustrates a control device 24 (e.g. e remote control) of a hearing aid device according to the invention. The control device 24 has a large display with a direction indicator 32 showing the listening direction. The control device 24 is provided with a rotation ball 26 configured to be used to change the listening direction. Thus, the control device 24 provides a useful means for controlling the directionality 32 of a hearing device.

The control device 24 comprises a first text field 28 in the lower portion of the display of the control device 24. The control device 24 moreover comprises a second text field 30 in the upper portion of the display of the control device 24. These text fields 28, 30 can be used to provide the user of the control device 24 with information. By way of example the lower text field 28 may present information such as: "Drag the handle to change the listening direction", while the upper text field 30 may present information like: "Directional Control".

The control device 24 is configured to facilitate optimisation of the audio processing of hearing aid instruments in order to suit the actual acoustic environment (that may be a noisy one).

The control device 24 provides a highly visual acoustical control that may be implemented on a SmartPhone or a tablet. The SmartPhone or a tablet may instantly response to the user both visually and acoustically.

The control device 24 provides a visual and discreet way of optimising audio processing of a hearing aid. As most people already have a SmartPhone the user of the hearing aid does not need to carry a separate remote control.

The control device 24 shown in FIG. 3 *b*) is a device (e.g. a SmartPhone) illustrating a scene showing a top view of a hearing aid user. The user of the control device 24 can rotate the figure and hereby change the scene by dragging/rotating the rotation ball 26 (or alternatively by sliding arrow 32 to a preferred direction with a finger on a touch sensitive screen). The hearing aid system applying the control device 24 will follow the user's gesture and adjust directionality parameters in real-time. Moreover, the user of the control device 24 will get instant visual and acoustical response.

A narrow beam directional microphone may be implemented in a dedicated external microphone array device or integrated in the control device 24 (e.g. using a 'pointer-APP' designed to run on a SmartPhone) or in a wireless streaming device or other accessories.

When the user applies the control device 24 to focus on a sound source, it is possible to indicate if the sound source is of interest or if it should be attenuated. The control device may comprise means for carrying out such a process.

The sound from the sound source may be streamed to the hearing aid together with the user's classification of it as being of interest or disturbing. The hearing aid now correlates the sound streamed from the control device 24 with the sound sources in the environment. The correlation may be based on a comparison of time segments of the full audio signals (e.g. in the time-frequency domain) or, for simplicity, e.g. be based on one or more specific characteristic parameters of the signals, e.g. fundamental frequency, modulation measure, etc. Hereby, it is possible to identify which sound sources the user is listening to. The identified sound sources are tagged by the hearing aid with the user classification of the sound sources.

This procedure may be repeated to classify several sound sources according to the dynamically changing user preferences. The hearing aid is configured to keep the tagging information associated to the sound sources and to use the information to steer the prioritisation and attenuation of sound sources in the environment regardless of the direction of the users head and head rotations.

Figure 4:
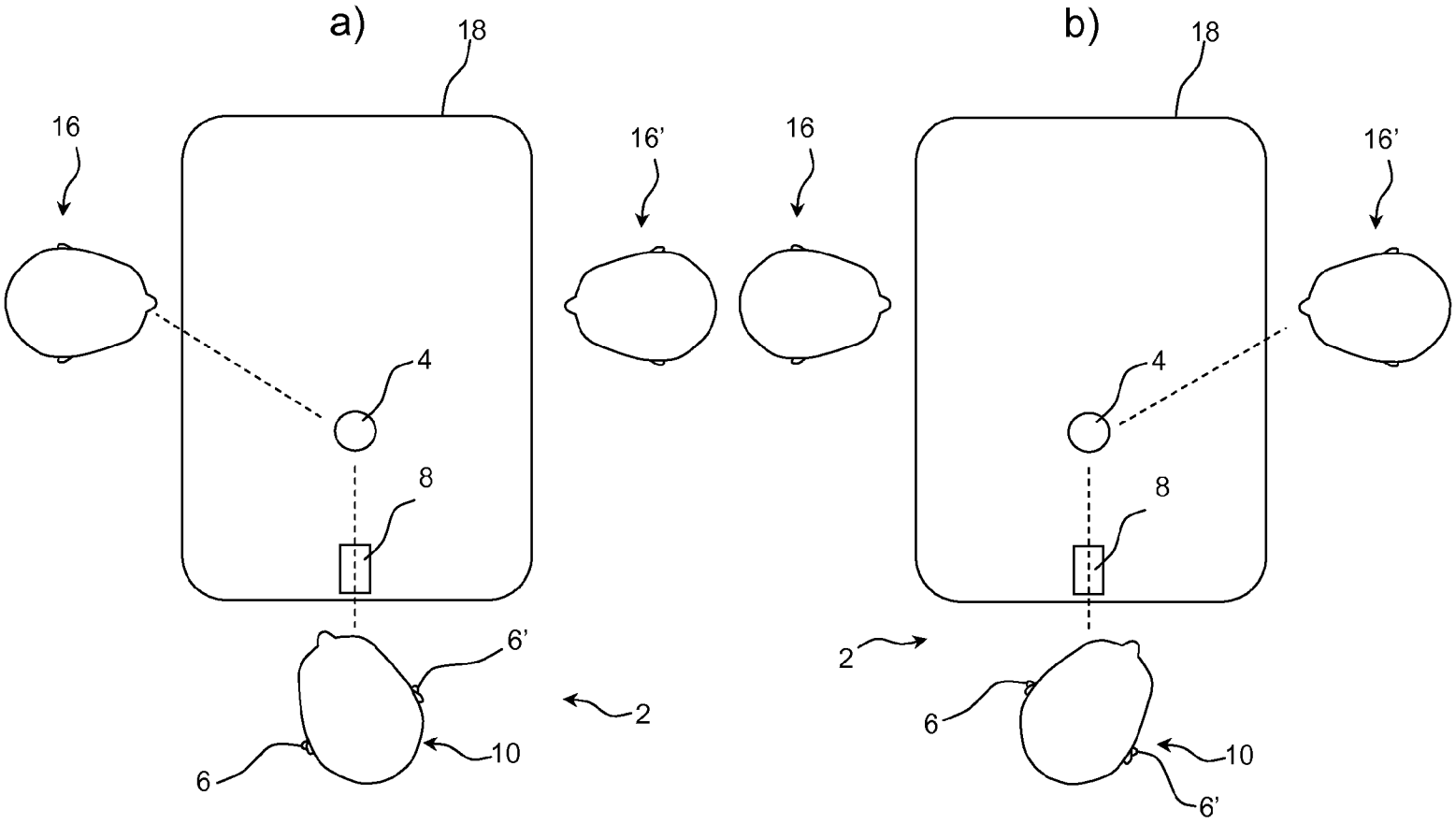
FIG. 4 shows a top view of a hearing aid system according to the invention used in two different situations.

FIG. 4 illustrates a top view of a hearing aid system 2 according to the invention used in two different situations. The hearing aid system 2 comprises a set of hearing aids 6, 6' arranged in or at the ears of the user 10 of the hearing aid system 2. The hearing aid system 2 also comprises an external microphone array 4 arranged on the table 18 and a remote control 8 arranged on the table 18 between the external microphone array 4 and the user 10 of the hearing aid system 2. The remote control 8 may alternatively be held by or be attached to the user 10 of the hearing aid system 2.

The user 10 of the hearing aid system 2 is sitting at the head of a table 18 while a first person 16 is sitting at the left side of the table 18 and a second person 16' is sitting at the right side of the table 18.

If the direction of the head of the user 10 of the hearing aid system 2 and the position of the microphone array 4 is not known it is possible to determine the changes of directions. If the microphone array 4 automatically changes its "listening direction" from one direction to another, then the hearing aid system is adapted so that the sound from the new "listening direction" is initially be presented to the user 10 of the hearing aid system 2 as if it originated from a direction equivalent to the change of "listening direction" of the microphone array 4.

In FIG. 4 *a*) the user 10 of the hearing aid system 2 is listening to a first person 16 sitting at the left side of the table 18, through the external microphone array 4 placed on the table 18 between the user 10 of the hearing aid system 2 and the first person 16. If we assume that the user 10 of the hearing aid system 2 and the first person 16 have been talking for a while, due to the HRTF applied, the signal from the external microphone array 4 would be presented to the user the user 10 as if the sound came from the position of the first person 16.

In FIG. 4 *b*) the second person 16' begins to talk and the first person 16 stops talking. Accordingly, then the microphone array 4 switches to zoom into the direction of the second person 16' instead of the first person 16.

Due to the fact that the second person 16' is sitting to the right of the user 10, the new signal transmitted from the external microphone array 4 to the hearing aid user 10 will initially be applied with a HRTF so that the sound appears to come from the right side of the user 10. The hearing aid system is adapted to provide that after a while the sound will fade into the frontal direction. Accordingly, the user 10 will know when to change the focus to the left or right, when the microphone array 4 automatically decides to change its listening direction.

In case neither the direction of the head of the user 10 nor the position of the microphone array 4 is known, the hearing aid system is adapted to correlate the transmitted signal from the external microphone array 4 with the signal picked up by the microphones in the two hearing aids 6, 6', to determine what HRTF to apply to the transmitted signal. Thereby the source being focused on by the external microphone array is determined by the direction of the user's head.

Figure 5:
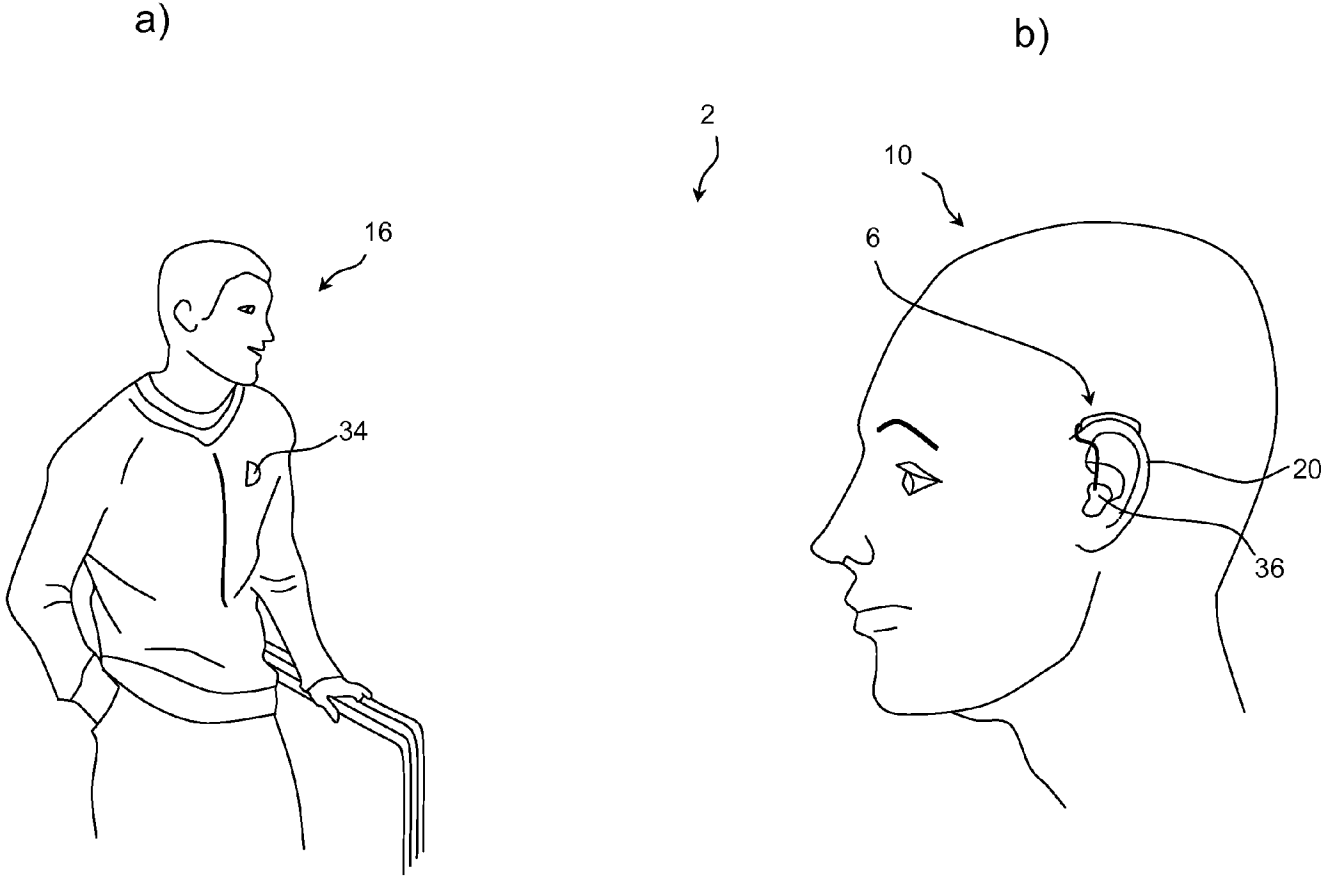
FIG. 5 shows a perspective view of a hearing aid system applying an external microphone attached to a speaking person.

FIG. 5 illustrates a perspective view of a hearing aid system 2 according to the invention. The hearing aid system 2 comprises a behind-the-ear (BTE) type hearing aid 6 worn by a user 10. However; it is important to note that the BTE type hearing aid may be substituted by other types of hearing aids. The BTE part of the hearing aid is attached behind the ear 20 (or behind pinna or rather between pinna and the skull) of the user 10. The hearing aid 6 further comprises an ear mould 36 adapted for being inserted into the ear 20 (or ear canal) of the user 10. The hearing aid system 2 comprises an external microphone (e.g. a microphone array) 34 attached to speaking person 16 being in the vicinity of (e.g. in the same room as) the user 10.

The external microphone 34 is wirelessly transmitting audio signals to a wireless receiver carried by the hearing aid user 10 in order to improve the signal-to-noise ratio. The wireless receiver may form part of the hearing aid or be a separate device of the hearing aid system 2 in communication with the hearing aid 6 (e.g. an audio gateway, a SmartPhone, or other intermediate device). The external microphone 34 is attached to the shirt of the speaking person 16 in order to enhance the communication. The hearing aid user 10 can then hear the voice of the speaking person 16 directly in the hearing aid 6.

If the person 16 wearing the external microphone 34 leaves the room and forgets that he is wearing the microphone 34, the hearing aid user 10 will unintendedly still be able to hear the person 16 wearing the external microphone 34 without the person's 16 knowledge.

To avoid that the external microphone 34 transmits signals to the hearing aid user 10, when the hearing aid user 10 is not in the same room, the wireless receiver of the hearing aid 6 is configured to detect if the external microphone user 16 is in the same room. The hearing aid 6 comprises a microphone and possibly a voice activity detector (not shown). The microphone can be located in the BTE part or in the ear mould or elsewhere. The built-in microphone and the voice activity detector are configured to detect if the voice of the external microphone wearing 16 is present in the room, and the system is configured to only allow transmission of the wireless audio signal from the external microphone 34 to the receiver of the hearing aid 6 when the built-in microphone (and possibly the voice activity detector) has detected the voice of the person 16 wearing the external microphone 34. Alternatively, the hearing aid system 2 can be configured to only allow reception of the wireless audio signal from the external microphone 34 under the mentioned condition. Accordingly, the user 10 of the hearing aid 6 will only receive signals from the external microphone 34 when the wearer of the external microphone 34 is in the room.

The receiver configured to detect if the wearer of the external microphone 34 is in the room may be integrated into the hearing aid 6 or be an external device that the hearing aid user 10 carries on him. In the latter case the external device receives the signal from the external microphone 34 and transmits it to the hearing aid 6.

In order not to transmit other sounds than the voice of the external microphone user 16, the external microphone 34 may have a build-in voice detection system, that only transmits when voice is present.

Such voice detection system may e.g. comprise a body vibration voice detector, that detects the vibration on the body of the external microphone wearer 16 from the persons own voice, and only transmits the microphone signal when present.

Figure 6:
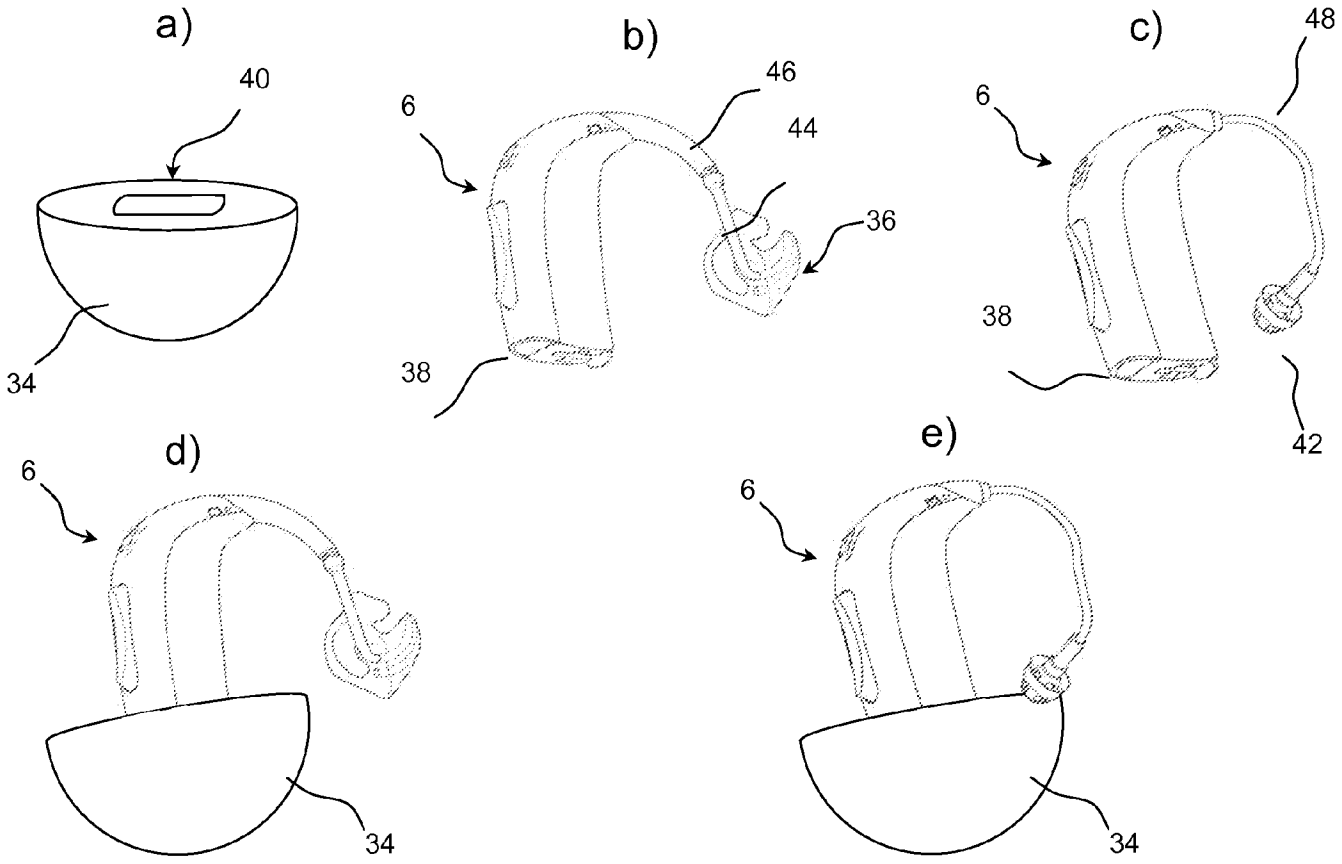
FIG. 6 shows a perspective view of hearing aids and corresponding external microphones.

FIG. 6 illustrates a perspective view of a plurality of hearing aids 6 and corresponding hemi-spherical external microphones array 34.

FIG. 6 *a*) illustrates a perspective side view of a hemi-spherical external microphone array 34. The external microphone array 34 is provided with a bore 40.

The bore 40 is configured to receive the hearing aid 6 shown in FIG. 6 *b*) and the hearing aid 6 shown in FIG. 6 *c*).

FIG. 6 *b*) illustrates a perspective front view of a BTE type hearing aid 6 comprising a case 38, a sound hook 46 and an ear mould 36 connected to the sound hook 46 through a tube 44. The BTE hearing aid 6 is configured to be inserted into the bore 40 of the external microphone array 34 as illustrated in FIG. 6 *d*).

FIG. 6 *c*) illustrates a perspective front view of another BTE type hearing aid 6 comprising a case 38, a thin tube 48 connected to a receiver to which a dome 42 is attached. The BTE hearing aid 6 is configured to be inserted into the bore 40 of the external microphone array 34 as illustrated in FIG. 6 *e*).

The embodiments shown in FIG. 6 are intended to help the user of the hearing aid 6 not to forget the external microphone 34. When the wireless connection of the external microphone array 34 is lost (without the user turning off either the transmitter or receiver) then the user would be alerted by an audio signal such as a beep (or other audio signal) in the hearing aid(s) 6, to remind him that the external microphone array 34 is forgotten (or connection lost).

In an embodiment, the external microphone array 34 comprises a local energy source, e.g. a battery, such as a rechargeable battery. In an embodiment, the external microphone array 34 comprises a connector to allow the rechargeable battery to be charged from a mains supply or from another device (e.g. via a USB connector). In an embodiment, the bore 40 is adapted to connect the hearing aid to a power source for charging a rechargeable battery of the hearing aid, while located in the bore. The source of energy for charging the battery of the hearing aid may come from the battery of the external microphone array or be supplied via a wireless or wired connection to another energy source, e.g. via a USB connector.

Example

Figure 7:
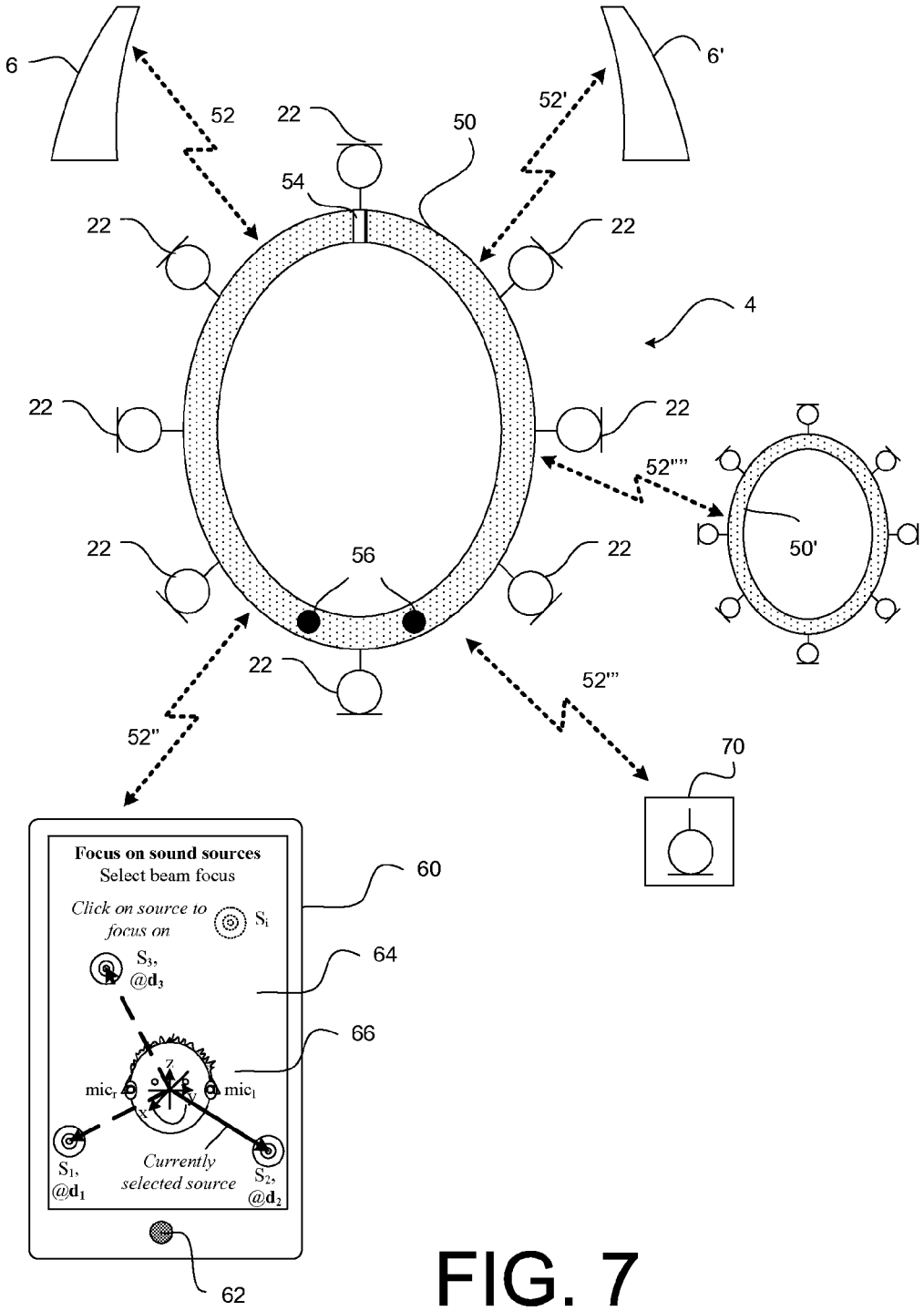
FIG. 7 schematically shows a cosmetically attractive listening neckband comprising a microphone array

Cosmetically Attractive Listening Neckband with Microphone Array for Improved Speech-to Noise Ratio and Built-in Connectivity 'The listening neckband' (as schematically illustrated in FIG. 7) is a cosmetically attractive high performance hearing solution. The neckband 50 works together with wireless earpieces, e.g. hearing aids 6, 6' (possibly downscaled versions comprising output transducers (e.g. loudspeakers) and limited audio processing). Main features of the neckband hearing solution (one or more of the following features may be included/combined according to the practical application):

Very attractive physical appearance neckband 50.

The Neckband comprises an array 4 of microphones 22, in FIG. 7 in 360 degrees around the head of the user allowing superior directionality (conveniently providing microphone pickup locations to the side of and behind the user, thereby truly reflecting a sound field surrounding the user). In an embodiment, the array comprises 4 or more microphones, e.g. 8 or more microphones, e.g. equally distributed around the periphery of the neckband (and thus the user's head when the user is wearing the neckband).

The Neckband 50 has wireless connection 52, 52' to Hearing Aids 6, 6'—e.g. based on induction or radiated fields (RF).

The Neckband 50 has low power wireless connection 52''' to an auxiliary device 60, e.g. a cellular or mobile phone, e.g. a SmartPhone.

The Neckband 50 has optional legacy Bluetooth connection to mobile phones 60, legacy Bluetooth being based on classic Bluetooth as specified by the Bluetooth Special Interest Group (SIG) (cf. e.g. https://www.bluetooth.org).

The Neckband 50 has connectivity to optional TV adapter for wirelessly transmitting TV sound to a hearing aid user.

The Neckband 50 has connectivity to external portable microphones 70 (e.g. partner microphones), or stationary microphones, e.g. located in various places at the user's house.

The Neckband 50 can receive audio wirelessly from a smartphones' microphone 62 allowing the user to use the smartphone 60 as a table microphone.

The Neckband 50 has a simple user interface 56, e.g. comprising Start/stop and volume buttons—a more sophisticated user interface is on the smartphone 60 (cf. exemplary APP 66 'Focus on sound sources' allowing a user to select a current sound source $S_i$ (i=1, 2, 3) on which to focus the directionality of the array of microphones 22 of the neck band 50 via the SmartPhone's touch sensitive display 64, e.g. by clicking on the source symbol $S_i$ or the corresponding arrow representing the direction vector from the user to the sound source $S_i$ of choice).

The Neckband 50 comprises a processor providing audio processing capability and/or the Neckband 50 leverages the smartphone CPU for vastly more computing power than what is possible with a hearing aid 6, 6'.

When used in connection with phone calls (providing wireless headset functionality), the Neckband 50 uses its microphone array 4 for superior noise reduction.

Two neckbands 50, 50' can be paired and transmit wireless audio to each other via wireless audio link 52'''' when they are within normal audible distance of each other. Useful for spouses or other regular communication partners.

The Neckband 50 may use Bluetooth Low Energy with an audio extension as wireless technology towards smartphone 60.

The Neckband 50 may use inductive wireless technology as wireless technology towards the hearing aids 6, 6' or Bluetooth Low Energy with an audio extension.

The Neckband 50 may be made in multiple colors.

The Neckband 50 may be opened and closed with a magnet closure mechanism 54.

The Neckband 50 may include a Telecoil receiver for inductively receiving baseband audio signals, e.g. in a church or other public or private location.

The Neckband 50 may include health monitoring features (e.g. fitness, sleep tracking, heart beat rate, temperature, EEG, etc.).

The Neckband 50 preferably comprises a local energy source, e.g. a battery, such as a rechargeable battery, e.g. a Li-ion rechargeable battery.

The Neckband 50 comprises appropriate functional units to allow the neckband to function as a microphone array and to communicate with ear pieces/hearing aid devices 6, 6', and possibly other devices. The functional units of the neckband include appropriate power supply, gain units, A/D converters, signal processing unit(s), antenna and transceiver units in operative connection with the microphones 22 of the microphone array 4. The antenna and transceiver units are configured to establish links 52, 52', 52", 52'", 52"" to other devices according to the practical application (such as ear pieces/hearing aids 6, 6', auxiliary device 60, external microphone 70, other Neckband(s) 50', other devices, e.g. a TV-adapter, etc.). The links may be based on near-field or far-field properties of the electromagnetic waves according to the practical solution. In an embodiment, the neckband comprises one or more conductors for implementing inductive and/or RF antenna(s). Preferably, the functional units of the Neckband (including an open-close mechanism) are designed with a view to other, more artistic features of the Neckband (such as color, material, texture, decoration, etc.) to allow the Neckband 50 to appear as a cosmetically attractive piece suitable for being worn around the neck of a user of the ear pieces/hearing aids 6, 6'. Preferably, the Neckband comprises non-functional features having a purely artistic purpose.

LIST OF REFERENCE NUMERALS

2—Hearing aid system
4—Microphone array
6, 6' —Hearing aid
8—Remote control (wireless)
10—User
12—Signal (ultrasonic)
14, 14' —Direction
16, 16' —Person
18—Table
20, 20' —Ear
22—Microphone
24—Control device
26—Rotation ball
28—Text field
30—Text field
32—Direction indicator
34—Microphone
36—Ear mould
38—Casing
40—Bore
42—Dome
44—Tube
46—Sound hook
48—Thin tube
50, 50' Neckband
52, 52', 52", 52", 52"" Wireless link
54 Open-close mechanism
56 Neckband user interface
60 Auxiliary device/Smartphone
62 Microphone
64 Display
66 APP (Focus on sound sources)
70 External microphone

The invention claimed is:

1. An external microphone array configured to be used with a hearing aid, the external microphone array comprising:

a number of microphones configured to detect one or more sound signals from a sound source; and transmitter circuitry for wirelessly transmitting the detected sound signal to at least one hearing aid; and a processing unit configured to automatically determine a direction of the sound source relative to the at least one hearing aid, by:

receiving a wireless signal transmitted from a remote control arranged between the external microphone array and the at least one hearing aid, the wireless signal including a direction from the external microphone array to the remote control, determining a direction of the sound source relative to the external microphone array, and determining the direction of the sound source relative to the at least one hearing aid based on information about the direction of the sound source relative to the external microphone array and the wireless signal received from the remote control.

2. An external microphone array according to claim 1, wherein the external microphone array has a spherical geometry.

3. An external microphone array according to claim 1, wherein the external microphone array has a hemi-spherical geometry.

4. An external microphone array according to claim 1, wherein a plurality of microphones are provided at the surface of the spherical or hemi-spherical geometry of the external microphone array.

5. An external microphone array according to claim 1, forming part of a communication device.

6. An external microphone array according to claim 1 forming part of a neckband.

7. An external microphone array according to claim 6 wherein the neckband comprises an array of microphones distributed around the head of the user.

8. An external microphone array according to claim 1 comprising a user interface.

9. A hearing aid system, comprising:

at least one hearing aid; and an external microphone array according to claim 1.

10. A hearing aid system according to claim 9, further comprising:

a remote control configured to provide a visual acoustical control, where the remote control is a smart phone or a tablet.

11. A hearing aid system according to claim 9, wherein the at least one hearing aid includes a signal processing unit configured to analyze acoustic signals picked up by the at least one hearing aid to automatically determine the direction of the sound source.

12. A hearing aid system according to claim 9, comprising a control device provided with a classifier for classification of signals detected from a sound source and an analyzer configured to analyze the classified signals.

13. A hearing aid system according to claim 12 comprising means for tagging classified signals and the associated sound sources, where the hearing aid system further comprises means for using this information to steer the prioritisation and attenuation of sound sources.

14. A hearing aid system according to claim 9, further comprising:

an external microphone or a second external microphone array configured to be worn by a person, which external microphone or second external microphone array is provided with a voice detection system configured to detect if the person wearing the external microphone or second external microphone array is speaking, where the hearing aid system is configured to transmit signals to the at least one hearing aid when the person is speaking, where the hearing aid system is configured not to transmit signals to the at least one hearing aid when the person is not speaking.

15. A hearing aid system according to claim 12, wherein the hearing aid system comprises a voice detector configured to detect a voice of the person wearing an external microphone or the external microphone array.

16. A hearing aid system according to claim 9, wherein the hearing aid system comprises an external microphone or a second external microphone array, and the system is configured to alert the user of the at least one hearing aid by providing a signal perceivable to the user in the at least one hearing aid when a wireless connection of the external microphone or the external microphone array to the at least one hearing aid is lost.

17. A hearing aid system according to claim 9, applying a head related transfer function (HRTF) to the signals received by the microphone array and providing signals to the at least one hearing aid in such a way that the processed signals basically appear as if they come from the direction of the sound source.

18. A method of operating an external microphone array configured to be used with at least one hearing aid, which microphone array includes a number of microphones configured to detect a sound signal from a sound source and a transceiver configured to wirelessly send the detected sound signal to the at least one hearing aid, the method comprising:

positioning a remote control between the external microphone array and the at least one hearing aid;

receiving a wireless signal transmitted from the remote control between the external microphone array and the at least one hearing aid, the wireless signal including a direction from the external microphone array to the remote control;

determining a direction of the sound source relative to the external microphone array; and determining the direction of the sound source relative to the at least one hearing aid based on information about the direction of the sound source relative to the external microphone array and the wireless signal received from the remote control.

19. The external microphone array according to claim 1, wherein, to determine the direction of the sound source relative to the external microphone array, the external microphone array is configured to receive wireless signals representing acoustic signals from the sound source picked up by the at least one hearing aid, shift in a number of steps, through an angle of space, a predefined directional characteristic, when the external microphone array is in a sound source search mode, compare by a cross-correlation, in each of the number of steps, the wireless signals representing the acoustic signals picked up the at least one hearing aid with corresponding acoustic signals received by the external microphone array, and determining, by the cross-correlation, a best correlation corresponding to the direction of the sound source relative to the external microphone array.

20. The external microphone array according to claim 19, wherein the external microphone array is configured to enter the sound source search mode by receiving a mode control input signal which is automatically generated by at least one of a movement of the user's head, and movement sensor located in the at least one hearing aid.

21. The method according to claim 18, wherein the determining the direction of the sound source relative to the external microphone array comprises:

receiving wireless signals representing acoustic signals from the sound source picked up by the at least one hearing aid;

shifting in a number of steps, through an angle of space, a predefined directional characteristic, when the external microphone array is in a sound source search mode;

comparing by a cross-correlation, in each of the number of steps, the wireless signals representing the acoustic signals picked up the at least one hearing aid with corresponding acoustic signals received by the external microphone array, and determining, by the cross-correlation, a best correlation corresponding to the direction of the sound source relative to the external microphone array.

22. The hearing aid system according to claim 10, wherein the remote control is configured to emit an ultrasonic signal, and the external microphone array is configured to detect the ultrasonic signal as the wireless signal transmitted from the remote control.

23. The method according to claim 18, further comprising:

transmitting an ultrasonic signal from the remote control, wherein the receiving the wireless signal transmitted from the remote control includes detecting said ultrasonic signal.

* * * * *